US008386181B2

(12) United States Patent
Propes

(10) Patent No.: US 8,386,181 B2
(45) Date of Patent: Feb. 26, 2013

(54) SYSTEM AND METHOD FOR BENT MOTOR CUTTING STRUCTURE ANALYSIS

(75) Inventor: Christopher C. Propes, Montgomery, TX (US)

(73) Assignee: National Oilwell Varco, L.P., Houston, TX (US)

( * ) Notice: Subject to any disclaimer, the term of this patent is extended or adjusted under 35 U.S.C. 154(b) by 246 days.

(21) Appl. No.: 12/859,918

(22) Filed: Aug. 20, 2010

(65) Prior Publication Data

US 2012/0046869 A1 Feb. 23, 2012

(51) Int. Cl.
*G01V 1/40* (2006.01)
*E21B 47/00* (2006.01)

(52) U.S. Cl. ..... 702/6; 175/40

(58) Field of Classification Search ..... 702/9; 408/3; 175/40

See application file for complete search history.

(56) References Cited

U.S. PATENT DOCUMENTS

| | | | | |
|---|---|---|---|---|
| 4,936,031 | A * | 6/1990 | Briggs et al. | 37/347 |
| 5,608,162 | A | 3/1997 | Ho | |
| 6,785,641 | B1 | 8/2004 | Huang | |
| 7,270,198 | B2 * | 9/2007 | Camp | 175/61 |
| 2002/0070021 | A1 * | 6/2002 | Van Drentham-Susman et al. | 166/298 |
| 2002/0185315 | A1 * | 12/2002 | McLoughlin et al. | 175/76 |
| 2005/0096847 | A1 | 5/2005 | Huang | |
| 2007/0192074 | A1 * | 8/2007 | Chen | 703/10 |
| 2009/0229888 | A1 | 9/2009 | Chen | |
| 2009/0308659 | A1 * | 12/2009 | Crowley et al. | 175/61 |

FOREIGN PATENT DOCUMENTS

| | | | |
|---|---|---|---|
| EP | 1146200 | A1 | 10/2001 |
| EP | 1371811 | A2 | 12/2003 |
| WO | 2005008022 | A1 | 1/2005 |

OTHER PUBLICATIONS

International Application No. PCT/US2011/046080 Search Report and Written Opinion dated Aug. 1, 2011, 10 pages.

* cited by examiner

*Primary Examiner* — Michael Nghiem
*Assistant Examiner* — Manuel Rivera Vargas
(74) *Attorney, Agent, or Firm* — Conley Rose, P.C.

(57) ABSTRACT

Techniques for analyzing operation of drill bit in a borehole are disclosed herein. A method for analyzing operation of a drill bit in a borehole includes providing information describing the drill bit and a bent housing coupled to the drill bit. A path of a cutter of the drill bit is determined based on a ratio of a rotational speed of the bent housing to a combined rotational speed of the drill bit and the bent housing. The combined rotational speed is different from the rotation speed of the bent housing.

19 Claims, 9 Drawing Sheets

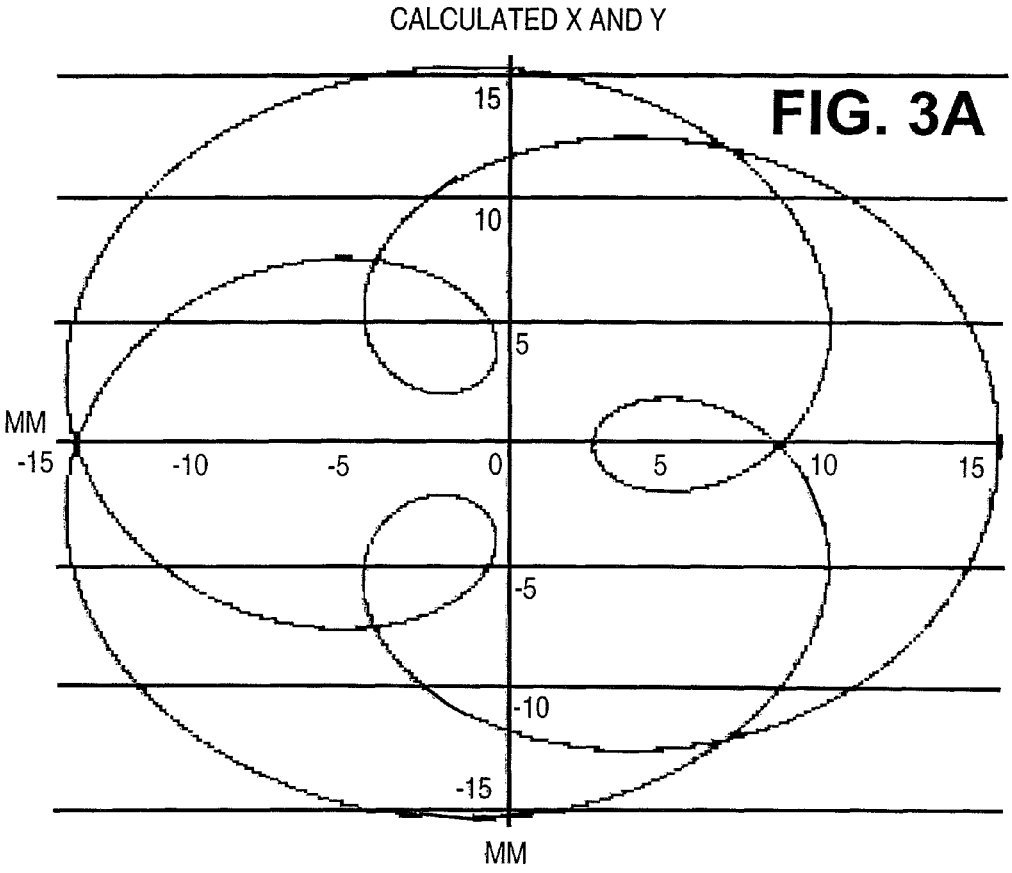
FIG. 3B
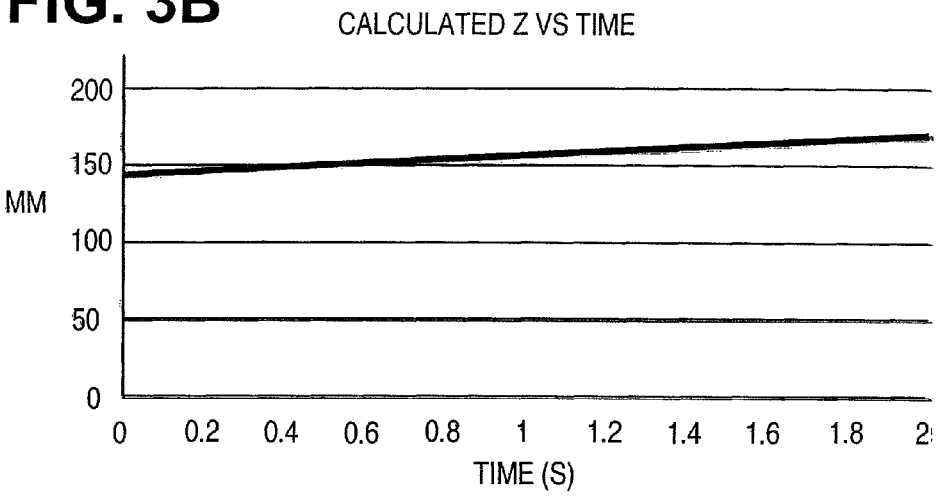

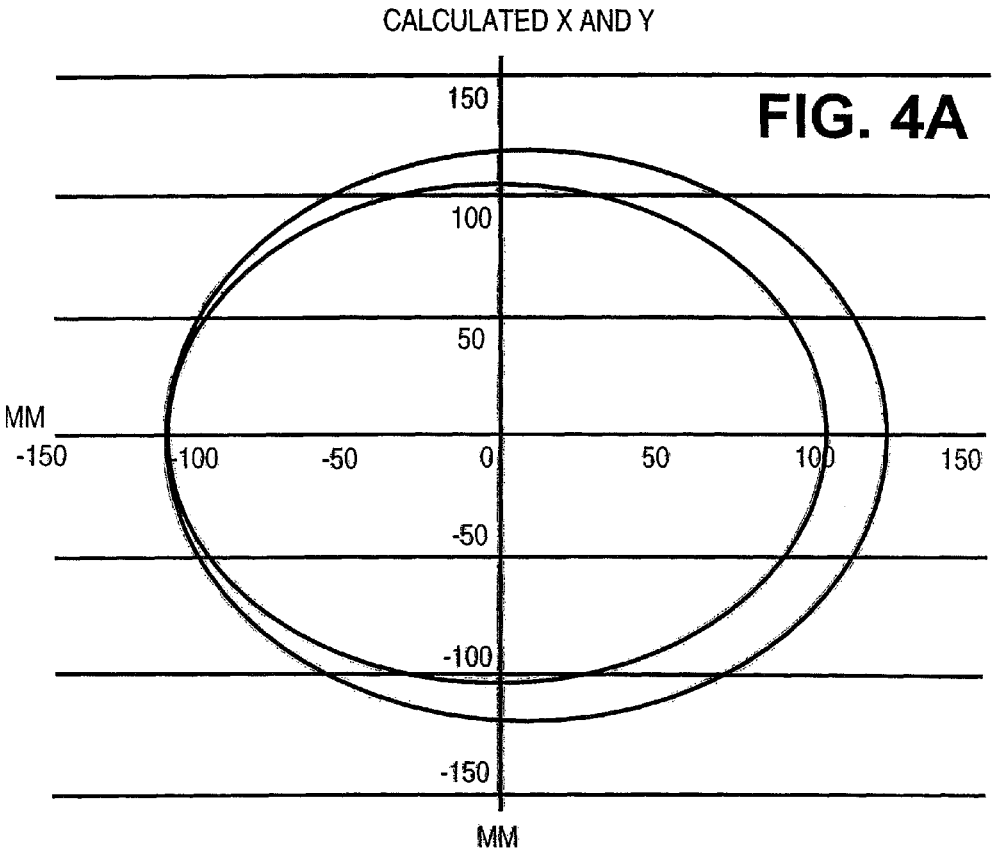
FIG. 4A
FIG. 4B
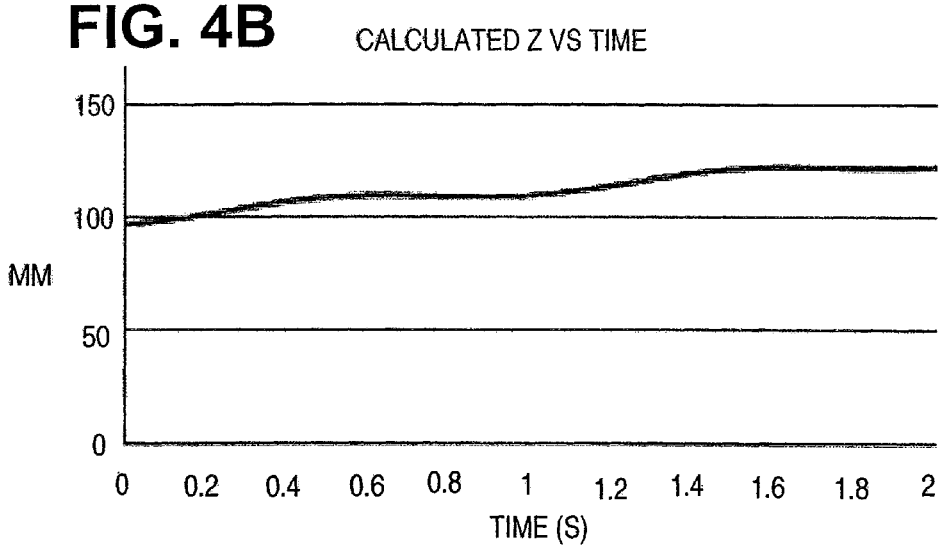

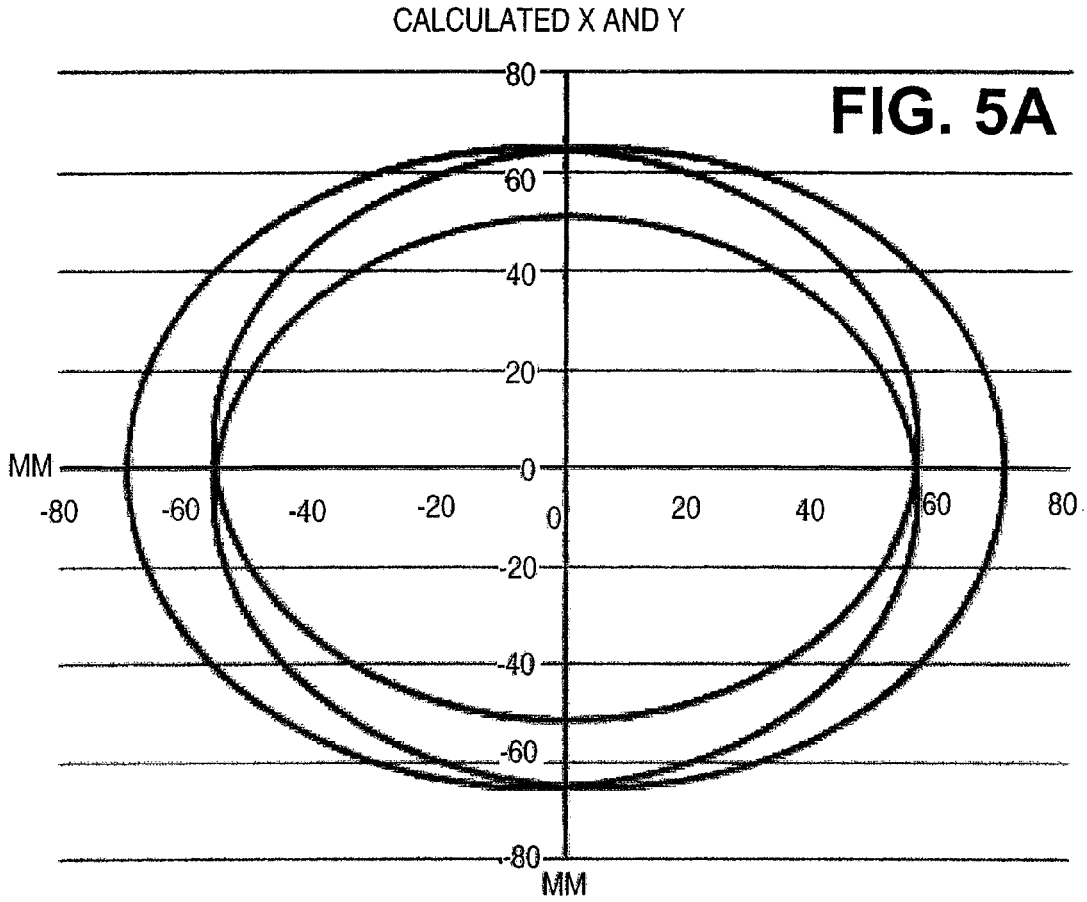
FIG. 5B
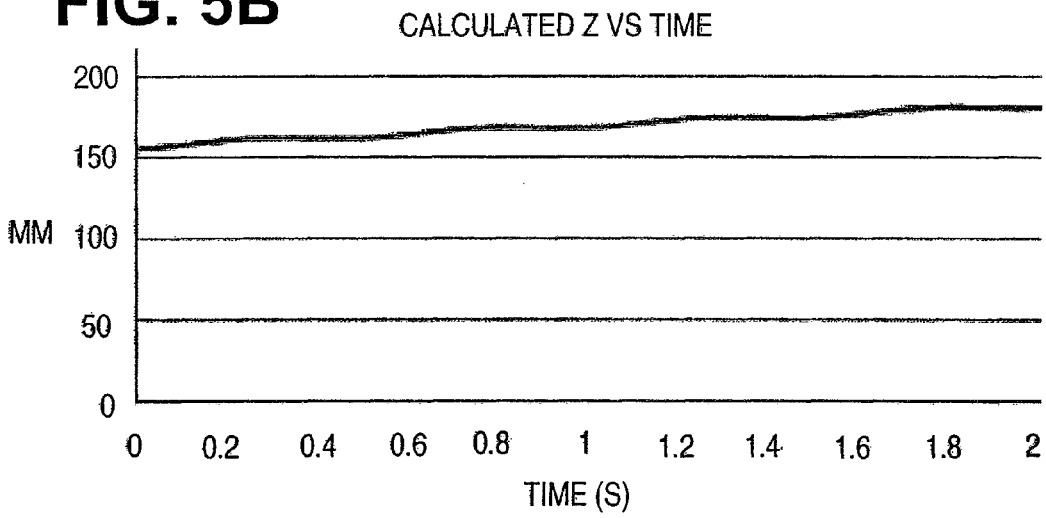

SYSTEM AND METHOD FOR BENT MOTOR CUTTING STRUCTURE ANALYSIS

BACKGROUND

In drilling a borehole (or wellbore) into the earth, such as for the recovery of hydrocarbons or minerals from a subsurface formation, it is conventional practice to connect a drill bit onto the lower end of an assembly of drill pipe sections that are connected end-to-end (commonly referred to as a "drill string"), and then rotate the drill string so that the drill bit progresses downward into the earth to create the desired borehole. In conventional vertical borehole drilling operations, the drill string and bit are rotated by means of either a "rotary table" or a "top drive" associated with a drilling rig erected at the ground surface over the borehole (or, in offshore drilling operations, on a seabed-supported drilling platform or suitably-adapted floating vessel).

During the drilling process, a drilling fluid (also commonly referred to in the industry as "drilling mud", or simply "mud") is pumped under pressure downward from the surface through the drill string, out the drill bit into the borehole, and then upward back to the surface through the annular space between the drill string and the wellbore. The drilling fluid, which may be water-based or oil-based, is typically viscous to enhance its ability to carry borehole cuttings to the surface. The drilling fluid can perform various other valuable functions, including enhancement of drill bit performance (e.g., by ejection of fluid under pressure through ports in the drill bit, creating mud jets that clean the bit's cutting elements and blast into and weaken the underlying formation in advance of the drill bit), drill bit cooling, and formation of a protective cake on the borehole wall (to stabilize and seal the borehole wall).

It has become increasingly common and desirable in the oil and gas industry to drill horizontal and other non-vertical boreholes (i.e., "directional drilling"), to facilitate more efficient access to and production from larger regions of subsurface hydrocarbon-bearing formations than would be possible using only vertical boreholes. In directional drilling, specialized drill string components and "bottom hole assemblies" are used to induce, monitor, and control deviations in the path of the drill bit, so as to produce a borehole of desired non-vertical configuration.

Directional drilling is typically carried out using a "downhole motor" (alternatively referred to as a "drilling motor" or "mud motor") incorporated into the drill string immediately above the drill bit. In drilling processes using a downhole motor, drilling fluid is circulated under pressure through the drill string and back up to the surface as in conventional drilling methods. However, the pressurized drilling fluid exiting the lower end of the drill pipe is diverted through the downhole motor to generate power to rotate the drill bit.

In directional drilling, the path of the drill bit is typically deviated in a desired direction by means of a bent housing or a bent sub, typically disposed within downhole motor. Bent subs and bent housings serve the same purpose, and in general terms differ only in that a bent housing is adapted to accommodate a drive shaft through its central bore. Bent subs and bent housings may be fashioned with a fixed or adjustable bend angle. The motion of a drill bit rotating in conjunction with a bent housing is complex, and consequently cannot be described using a simple helical model.

SUMMARY

Techniques for analyzing operation of drill bit and a bent housing in a borehole are disclosed herein. In one embodiment, a method for analyzing operation of a drill bit in a borehole includes providing, to one or more processors, information describing the drill bit and a bent housing coupled to the drill bit. A path of a cutter of the drill bit is determined, by the one or more processors, based on a ratio of a rotational speed of the bent housing to a combined rotational speed of the drill bit and the bent housing. The combined rotational speed is different from the rotational speed of the bent housing.

In another embodiment, a method for determining a drill bit parameter of a drill bit design includes simulating, using an epitrochoidal function, a path traveled by a cutter of a simulated drill bit coupled to a bent housing. A parameter of the simulated drill bit is changed based on a result of the simulation.

In a further embodiment, a system for analyzing operation of a drill bit in a borehole comprises one or more processors and cutter path logic. The cutter path logic causes the one or more processors to determine a path traveled by a cutter of the drill bit based on a ratio of a rotational speed of a bent housing coupled to the drill bit to a combined rotational speed of the drill bit and the bent housing. The total rotational speed is different from the rotational speed of the bent housing.

BRIEF DESCRIPTION OF THE DRAWINGS

For a detailed description of exemplary embodiments of the invention, reference will now be made to the accompanying drawings in which:

FIGS. 3A-5B show X-Y and Z components of cutter path motion for various combinations of bent housing and drill bit rotation speeds, simulated in accordance with various embodiments;

NOTATION AND NOMENCLATURE

Certain terms are used throughout the following description and claims to refer to particular system components. As one skilled in the art will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct physical and/or electrical connection. Thus, if a first device couples to a second device, that connection may be through a direct physical and/or electrical connection, or through an indirect physical and/or electrical connection via other devices, components, and connections.

DETAILED DESCRIPTION

The following discussion is directed to various embodiments of the invention. Although one or more of these embodiments may presently be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

The forces encountered by a drill bit when drilling a borehole can be simulated and analyzed as an aid to drill bit design. Simulation of such forces is based in part on the motion of the drill bit in the wellbore. The motion of a drill bit disposed on a drill string that includes a bent housing is a function of a plurality of variables, including housing and bit rotation rates, bend angle, housing dimensions, etc. Consequently, the cutting path of a drill bit's cutters disposed on a drill string including a bent housing cannot be described using a simple helical model.

Embodiments of the present disclosure employ techniques for mathematically simulating the path traveled by a fixed cutter of a drill bit that is used in conjunction with a downhole bent housing motor. The simulated travel paths of the cutters of a drill bit may be applied to determine drilling forces on the cutters. Drill bit design may be optimized based on the determined drilling forces.

Figure 1:
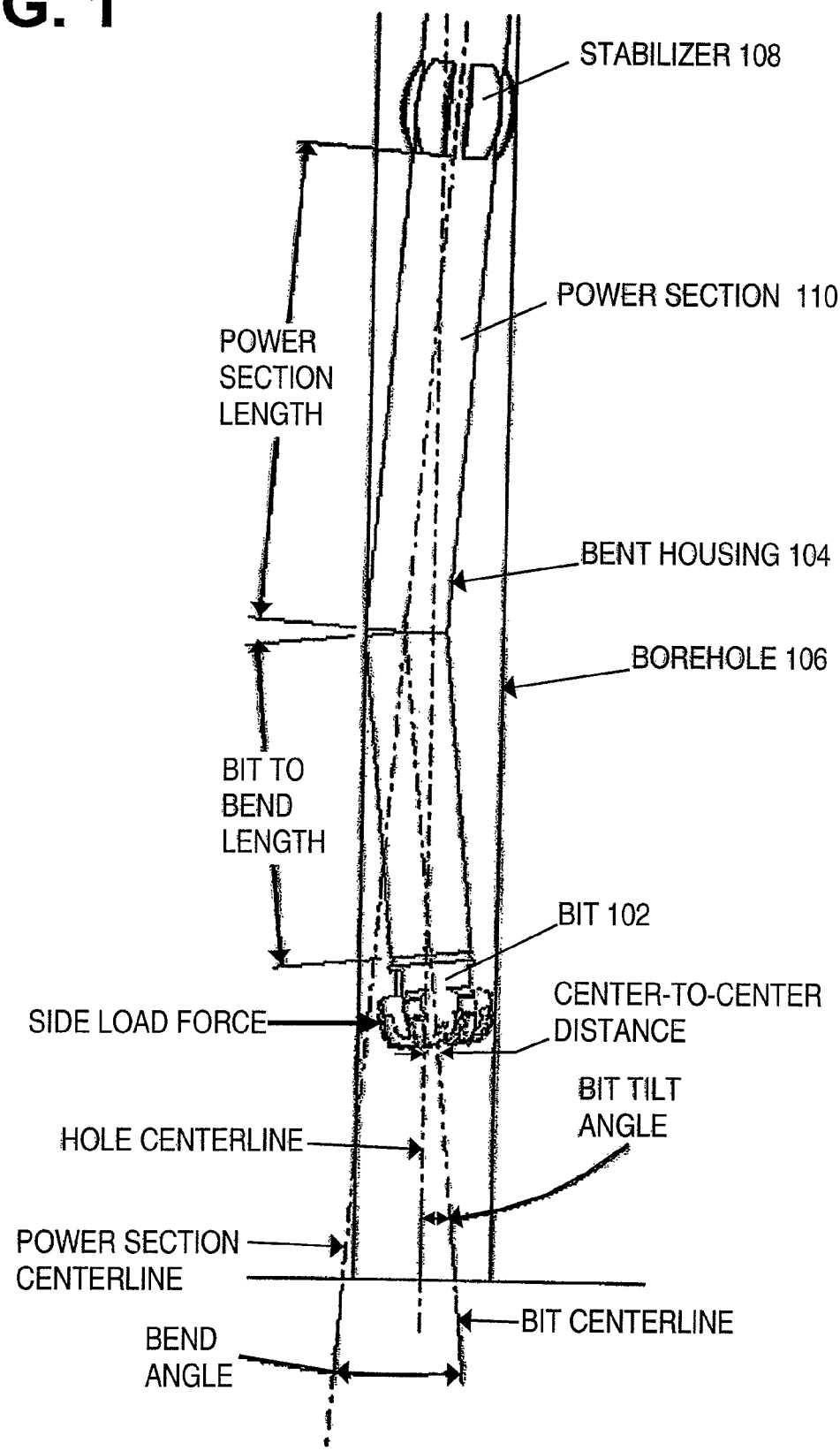
FIG. 1 shows a side elevation view of a drill bit and a bent housing disposed in a borehole in accordance with various embodiments.

FIG. 1 shows a drill bit 102 coupled to a bent housing 104 disposed in a borehole 106 for drilling subsurface formations in accordance with various embodiments. The drill bit 102 may be a fixed cutter design, such as a polycrystalline diamond compact ("PDC") bit. The deflection of the bent housing 104 is exaggerated for purposes of illustration. In practice, an angle of 2°-2.5° in the bent housing may be considered significant.

The bent housing 104 contains a downhole motor driven by the flow of pressurized drilling fluid through the drill string. The downhole motor includes a power section comprising a positive displacement motor that produces rotational motion for driving the drill bit 102.

Borehole direction may be changed by rotating the drill bit 102, via the mud motor, while the bent housing 104 is prevented from rotating. Borehole direction is maintained by rotating both the drill bit 102 and the bent housing 104. The bent housing 104 may be rotated from the surface by rotational motion imparted to the drill string, while the drill bit 102 is driven by the mud motor.

Embodiments of the present disclosure simulate the complex motion generated by a cutter of the rotating drill bit 102 that is disposed on a rotating bent housing 104. FIG. 1 illustrates various parameters (e.g., bit tilt angle, center-to-center distance, etc.) of the bent housing 104 and the drill bit 102 used to compute the cutter motion simulation. FIG. 1 also shows a stabilizer 108 disposed in the power section 110. Additional stabilizers may be located at other positions (e.g., a near bit stabilizer), and embodiments of a cutter motion simulator disclosed herein are configured to simulate effects of any combination of stabilizers, bent housing, drill bit and borehole.

Figure 2:
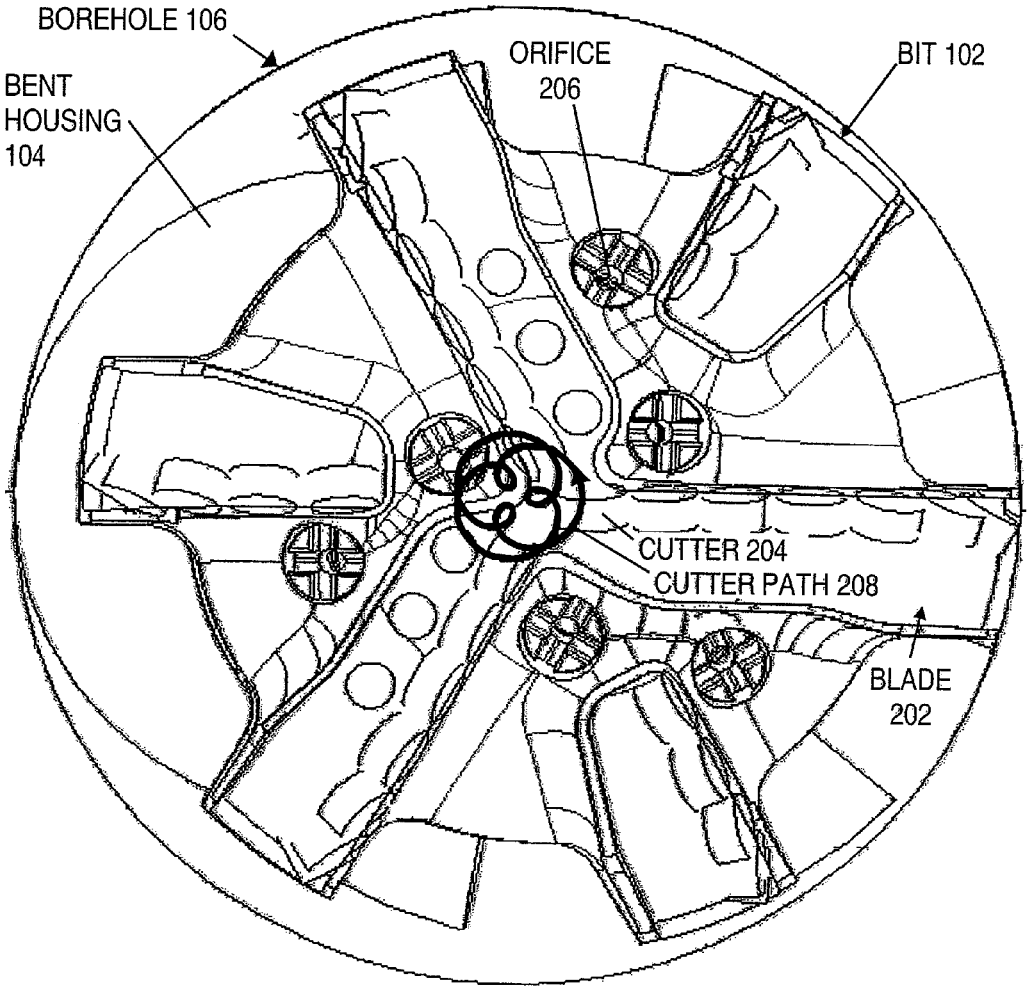
FIG. 2 shows a bottom view of the drill bit of FIG. 1 coupled to a bent housing and a path traveled by a cutter of the drill bit in accordance with various embodiments.

FIG. 2 shows a bottom view of the drill bit 102 and a path 208 traveled by a cutter 204 in accordance with various embodiments. Although the path 208 appears in FIG. 2 as a path in a single plane, it will be understood that as the bit 102 progresses deeper into a formation being drilled, the path of the bit also includes a component of longitudinal motion (i.e., in a Z direction, where path 208 is in the X-Y plane). The drill bit 102 includes a plurality of blades 202, and each blade 202 includes a plurality of cutters 204. The cutters 204 scrape rock from the formations being drilled as the drill bit 102 rotates in the borehole 106. The bit 102 also includes orifices 206 through which drilling fluid is sprayed into the borehole 106.

The cutter path 208 illustrates the complex track traveled by the cutter 208 as the bent housing 104 rotates and the drill bit 102 rotates independently from the bent housing 104 (i.e., driven by a mud motor) in the borehole 106. Each cutter 204 travels a different path determined by the rotation speeds of the bent housing 104 and the drill bit 102, and the dimensional parameters of the bent housing 104, the drill bit 102 and the borehole 106.

Embodiments of the present disclosure model the complex motion of each cutter 204 using epitrochoidal functions to determine the lateral motion (i.e., perpendicular to the drill string, in an X-Y plane) of the cutter 204. Embodiments the simulator describe the lateral motion of a cutter 204 as:

$$X = (a+b)\cos(\theta) - h\cos\left(\frac{a+b}{b}\theta\right), \text{ and} \tag{1}$$

$$Y = (a+b)\sin(\theta) - h\sin\left(\frac{a+b}{b}\theta\right) \tag{2}$$

When applying these equations to the bent motor simulation:

- a and b are functions of the distance from the center of the bit 102 to the center of the borehole 106 (Center to Center Distance, FIG. 1);
- θ is the rotation angle of the entire motor assembly; and
- h is the radial distance from the cutter 204 to the center of the bit 102.

Embodiments convert the results of equations (1) and (2) above to polar coordinate form and apply a global angular offset to the angle of the polar coordinates. The global angular offset is related to the blade angle of the drill bit 102 and allows for analysis of cutters 204 that begin the simulation at other than 0°.

Embodiments of the simulator described herein combine linear and sinusoidal functions to model longitudinal motion (i.e., along the drill string, Z-plane) of the cutter 204. Sinusoidal motion results from the combination of the bit 102 being tilted in the borehole 106 and the bit 102 rotating about its own axis. The linear function incorporates the rate of penetration into the simulation. Embodiments of the simulator describe the longitudinal motion of the cutter 204 as:

$$Z = \text{amplitude}\frac{\sin(\pi(t - \text{offset}))}{.5\ \text{period}} + \text{slope} * t + \text{initial_Z} \tag{3}$$

where:

- amplitude is a function of the radial position of the cutter and bit tilt angle;
- offset is a phase offset determined by the ratio of rotary revolutions per minute ("RPM") to mud motor RPM, and blade angle;
- period is rotary RPM divided by mud motor RPM; and
- slope is rate of penetration.

The cutter 204 motion simulation described above may be implemented in accordance with the following pseudo-code. While the exemplary code below shows parameter entry via assignment, embodiments of a motion simulator may read such parameter values from a file (e.g., a drill bit parameter file) or receive parameter values via user entry or another source. In some simulator embodiments, Center-to-Center distance and/or Bit Tilt Angle are calculated using known parameters of the bent housing 104, for example, Bit to Bend Length and Bend Angle (FIG. 1).

```
% set simulation time parameters
t=[0.005:0.005:2]; % 2 second simulation
% input drill bit/cutter data
Radial_Position = −6.5;
Initial_Z = 157;
Blade_Angle = 300; % blade angle in degrees
% input additional simulation parameters
Rotary_RPM = 60;
Motor_RPM = 90;
ROP = 150                                   % rate of penetration in ft/hr
Center_to_Center = 9.14;                    % hole center to bit center in mm
Bit_Tilt = 1.423; % hole centerline to bit centerline angle in degrees
%Calculated Constants
Period = Rotary_RPM/Motor_RPM;              % Period of Z displacement wave
Phase_Offset = (Period/4)−(Blade_Angle/360)*Period;        % Offset of Z wave
  for variable blade start angles
Total_RPM = Rotary_RPM+Motor_RPM;           % determine combined rotational speed
RPM_Ratio = Rotary_RPM / Total_RPM;
b = Center_to_Center * RPM_Ratio;
a = Center_to_Center-b;
radians = pi/180;                           % converts degrees to radians
degrees = 180/pi;                           % converts radians to degrees
Amplitude = abs(Radial_Position*sin(radians*Bit_Tilt));
Slope = ROP*0.084666667;                    %convert ft/hr to mm/sec
Rotary_Theta = t*Rotary_RPM*6;
% epitrochoid equations
x_temp=((a+b).*cos(radians.*(Rotary_Theta)))−
Radial_Position.*cos((a/b+1).*radians.*(Rotary_Theta));
% epitrochoid equations
y_temp=(a+b).*sin(radians.*(Rotary_Theta))−
Radial_Position.*sin((a/b+1).*(radians.*Rotary_Theta));
% convert x_temp and y_temp to polar coordinate
r = (x_temp.^2.+y_temp.^2).^.5;
theta_temp = (degrees*(atan2(y_temp,x_temp)));
% adjust theta for blade angle
theta = theta_temp−Blade_Angle;
% adjust and convert from polar to rectangular
X = r.*cos(radians.*theta);
Y = r.*sin(radians.*theta);
% compute longitudinal motion
Z = Amplitude.*sin((pi.*(t-Phase_Offset))/(.5*Period)) + Slope.*t+Initial_Z;
```

Some embodiments of a cutter path simulator provide for a bent housing 104 that is rigid. If the bent housing 104 is not allowed to flex, then the drill bit 102 will drill a hole having a diameter larger (e.g., 0.100" larger diameter) than the nominal diameter of the drill bit. Under such conditions, equations (1)-(3) describe the motion of the cutter 204.

Some embodiments of a cutter path simulator provide for disposing the bent housing 104 into a borehole 106 that is only slightly larger than the diameter of the drill bit 102 (e.g., a borehole diameter less than 0.100" larger than the bit diameter). When the bent housing 104 is deflected by the borehole 106, a side cutting force will be applied to the drill bit 102. Embodiments of the simulator compute the amount of deflection based on the borehole 106 diameter and the geometry of the bent housing 104. The computed deflection is used to determine a side load force (FIG. 1) applied to the drill bit 102 simulation. Equations (1)-(3) are applicable to such a simulation, however, to determine the amount of deflection, input information describing the geometry of the bent housing 104 are used. Applicable input information may include Bit Length, Bit-to-Bend Length, Overall Motor Length, Lower Stabilizer Location, Lower Stabilizer Diameter, Upper Stabilizer Location, Upper Stabilizer Diameter, Motor Diameter, Bend Angle, etc. Center-to-Center Distance and Bit Tilt Angle, as well as the maximum bend angle fitting in a specified hole diameter can be computed from the input information. When the bend angle of the motor exceeds the maximum bend angle allowed by the geometry of the motor, stabilizers, and borehole wall, then the motor may have to flex to fit within the borehole, which will in turn cause the side load force to be applied to the cutting structure. The side load force applied in a cutter path simulation can be determined by relating the bend angle of the housing 104 to the computed maximum bend angle.

FIGS. 3A-3B show X-Y and Z components of cutter path motion for one combination of bent housing 104 and drill bit 102 rotation speeds and dimensions simulated in accordance with various embodiments. A simulator applying equations (1)-(3), as embodied in the pseudo-code shown above may be used to generate the cutter 204 path shown in FIGS. 3A and 3B. FIG. 3A shows the path of the cutter 204 in the X-Y plane (i.e. the lateral path) with the bent housing 104 rotating at 60 RPM (i.e., Rotary_RPM=60) and the drill bit 102 rotating at 90 RPM (i.e., Motor RPM=90). FIG. 3B shows the path of the cutter 204 in the Z plane (i.e. the longitudinal path) with the bent housing 104 rotating at 60 RPM, the drill bit 102 rotating at 90 RPM, and a rate of penetration of 150 feet per hour.

FIGS. 4A-4B show X-Y and Z components of cutter path motion for another combination of bent housing 104 and drill bit 102 rotation speeds and dimensions simulated in accordance with various embodiments. A simulator applying equations (1)-(3), as embodied in the pseudo-code shown above may be used to generate the cutter 204 path shown in FIGS. 4A and 4B. FIG. 4A shows the path of the cutter 204 in the X-Y plane (i.e. the lateral path) with the bent housing 104 rotating at 60 RPM (i.e., Rotary_RPM=60) and the drill bit 102 rotating at 60 RPM (i.e., Motor_RPM=60). FIG. 3B shows the path of the cutter 204 in the Z plane (i.e. the longitudinal path) with the bent housing 104 rotating at 60 RPM, the drill bit 102 rotating at 60 RPM, and a rate of penetration of 150 feet per hour.

FIGS. 5A-5B show X-Y and Z components of cutter path motion for another combination of bent housing 104 and drill bit 102 rotation speeds and dimensions simulated in accordance with various embodiments. A simulator applying equations (1)-(3), as embodied in the pseudo-code shown above may be used to generate the cutter 204 path shown in FIGS. 5A and 5B. FIG. 5A shows the path of the cutter 204 in the X-Y plane (i.e. the lateral path) with the bent housing 104 rotating at 60 RPM (i.e., Rotary_RPM=60) and the drill bit 102 rotating at 120 RPM (i.e., Motor_RPM=120). FIG. 3B shows the path of the cutter 204 in the Z plane (i.e. the longitudinal path) with the bent housing 104 rotating at 60 RPM, the drill bit 102 rotating at 120 RPM, and a rate of penetration of 150 feet per hour.

Figure 6:
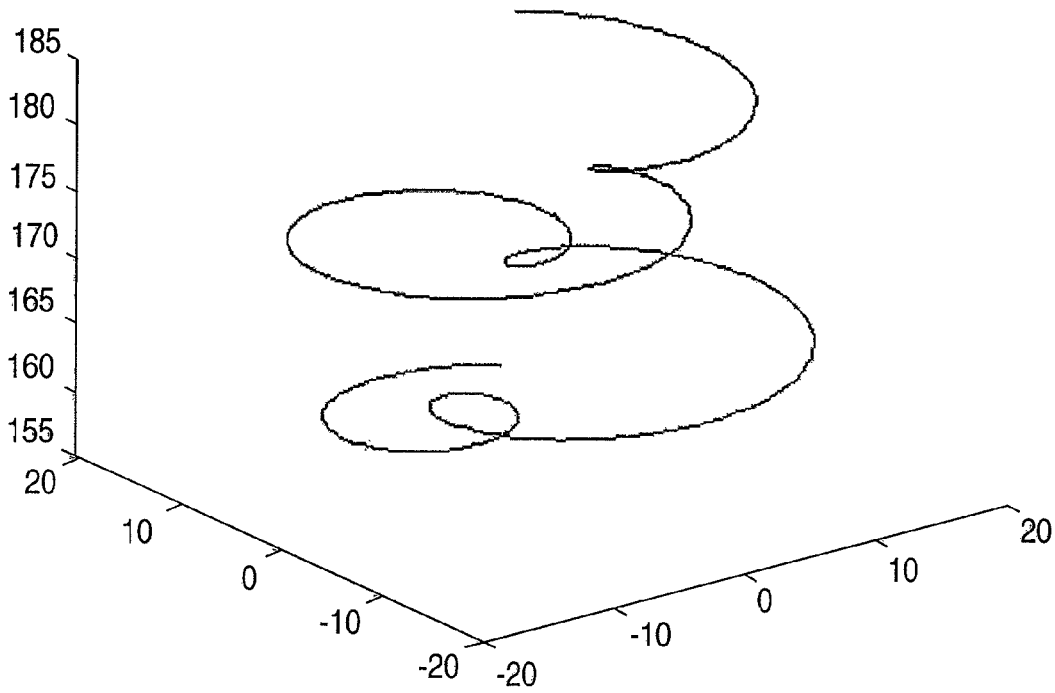
FIG. 6 shows a simulated three dimensional cutter path for one combination of bent housing and drill bit rotation speeds, simulated in accordance with various embodiments.

FIG. 6 shows a simulated three dimensional path for the cutter 204 for one combination of bent housing 104 and drill bit 102 rotation speeds and parameters simulated in accordance with various embodiments. The path of FIG. 6 incorporates the X, Y, and Z motion components produced by a simulator applying equations (1)-(3) as illustrated in FIGS. 3A and 3B.

Figure 7:
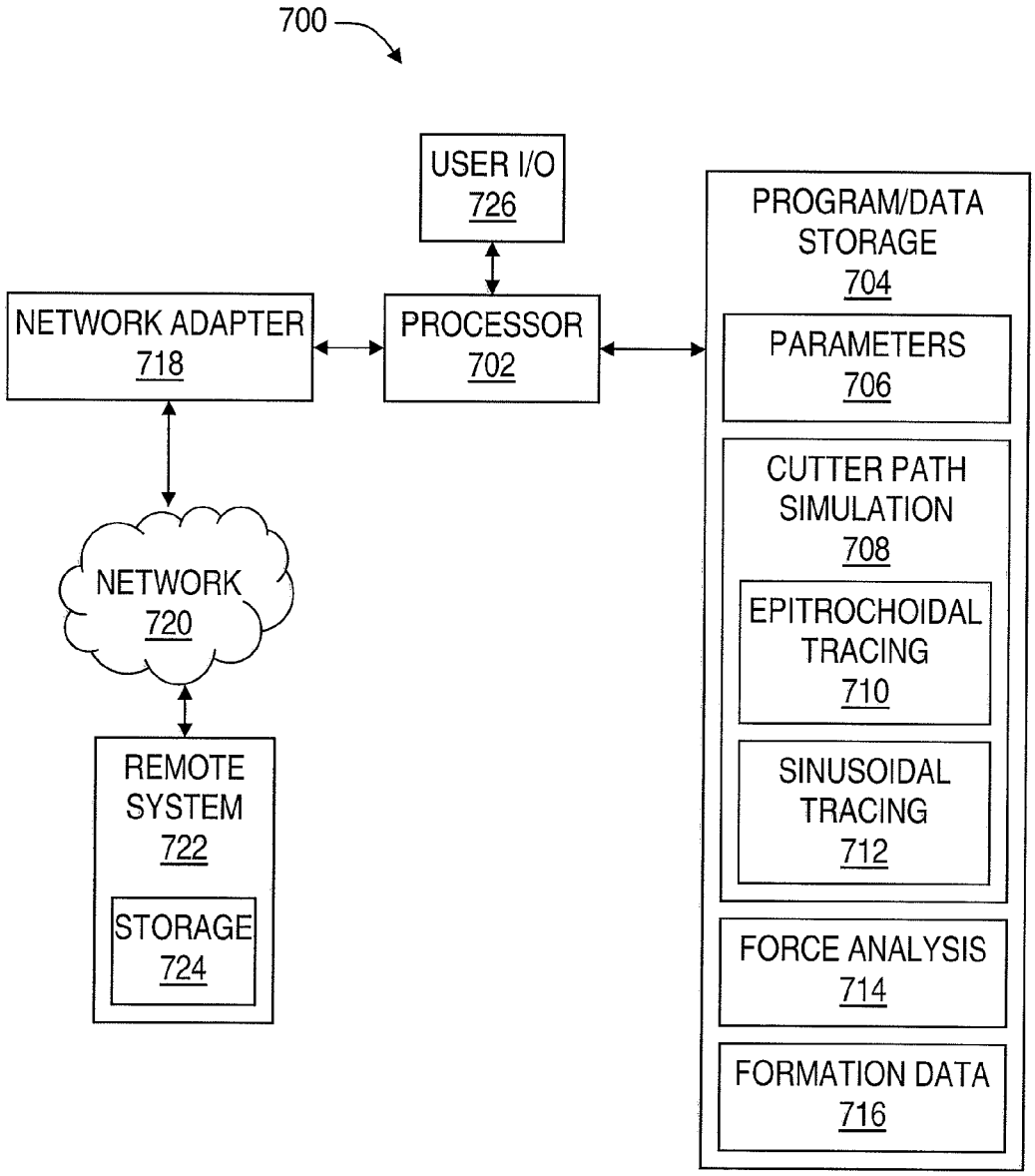
FIG. 7 shows a block diagram for a system for analyzing drill bit operation in accordance with various embodiments.

FIG. 7 shows a block diagram for a system 700 for analyzing drill bit 102 operation in accordance with various embodiments. The system 700 includes program/data storage 704 and one or more processors 702. Some embodiments of the system 700 also include a network adapter 718 and user I/O devices 726. These elements of the system 700 may be embodied in one or more computers as are known in the art. Desktop computers, server computers, notebook computers, handheld computers, etc. are exemplary computers that may suitably embody at least some components of the system 700.

The processor 702 is configured to execute instructions read from a computer readable medium, and may, for example, be a general-purpose processor, digital signal processor, microcontroller, etc. Processor architectures generally include execution units (e.g., fixed point, floating point, integer, etc.), storage (e.g., registers, memory, etc.), instruction decoding, peripherals (e.g., interrupt controllers, timers, direct memory access controllers, etc.), input/output systems (e.g., serial ports, parallel ports, etc.) and various other components and sub-systems.

The program/data storage 704 is a computer-readable storage medium that may be coupled to and accessed by the processor 702. The storage 704 may be volatile or non-volatile semiconductor memory (e.g., FLASH memory, static or dynamic random access memory, etc.), magnetic storage (e.g., a hard drive, tape, etc.), optical storage (e.g., compact disc, digital versatile disc, etc.), etc. Embodiments of the program/data storage 704 may be local to or remote from the processor 702. Various programs executable by the processor 702, and data structures manipulatable by the processor 702 may be stored in the storage 704.

User I/O devices 726 coupled to the processor 702 may include various devices employed by a user to interact with the processor 702 based on programming executed thereby. Exemplary user I/O devices 726 include video display devices, such as liquid crystal, cathode ray, plasma, organic light emitting diode, vacuum fluorescent, electroluminescent, electronic paper or other appropriate display devices for providing information to a user. Such devices may be coupled to the processor 702 via a graphics adapter or other suitable interface. Keyboards, touchscreens, and pointing devices (e.g., a mouse, trackball, light pen, etc.) are examples of devices includable in the I/O devices 726 for providing user input to the processor 702 and may be coupled to the processor 702 by various wired or wireless communications subsystems, such as Universal Serial Bus or Bluetooth.

A network adapter 720 may coupled to the processor 702 to allow the processor 702 to communicate with a remote system 722 via the network 720 to, for example, access the storage 724, provide services to and/or request services from the remote system 722. The network adapter 718 may allow connection to one or more of a wired or wireless network, for example, in accordance with IEEE 802.11, IEEE 802.3, Ethernet, a cellular network, etc. The network 720 may comprise any available computer networking arrangement, for example, a local area network ("LAN"), a wide area network ("WAN"), a metropolitan area network ("MAN"), the internet, etc. Further, the network 720 may comprise any of a variety of networking technologies, for example, wired, wireless, or optical techniques may be employed. Accordingly, the remote system 722 and is not restricted to any particular location or proximity to the processor 702.

Referring again to the program/data storage 704, various data and program modules are shown stored therein. The cutter path simulation module 708 includes instructions that when executed cause the processor 702 to determine the travel path of a cutter 204 of the drill bit 104 coupled to a bent housing 104. The cutter path simulation module 708 includes epitrochoidal tracing logic 710 implementing the operations of equations (1)-(2) above for determining the lateral motion of the cutter 204. The sinusoidal tracing logic 712 implements the operations of equation (3) above to determine the longitudinal motion of the cutter 204. The cutter path simulation module 708 may also configure the processor 702 to determine and apply a side load force (FIG. 1) to the drill bit 102. The various computations performed to determine lateral and longitudinal motion of the cutter 204 may be based on bit 102 and housing 104 dimensions, and other information (e.g., rotation speed, borehole diameter, etc.) stored in the parameter 706 portion of the storage 704.

The force analysis module 714 includes instructions that when executed cause the processor 702 to determine the forces on each cutter of the drill bit 102 as the drill bit 102 is drilling the borehole 106. Some embodiments of the force analysis module 714 move each simulated cutter 204 along the path determined for the cutter 204 by the cutter path simulation module 708 to created a cutter pattern representative of the bit 104 rotating the borehole 106. The force analysis module 714 then determines the area cut by each cutter 204, and compares the determined area to force tables generated from empirical testing on similar cutters in similar formation strengths to estimate the forces to which each cutter 204 is subjected. The force tables may be included in the formation data 716.

Some embodiments of the force analysis module 714 determine the dynamic forces on each cutter by applying Finite Element Analysis to sweep a three dimensional model of each cutter 204 through a simulated rock.

Figure 8:
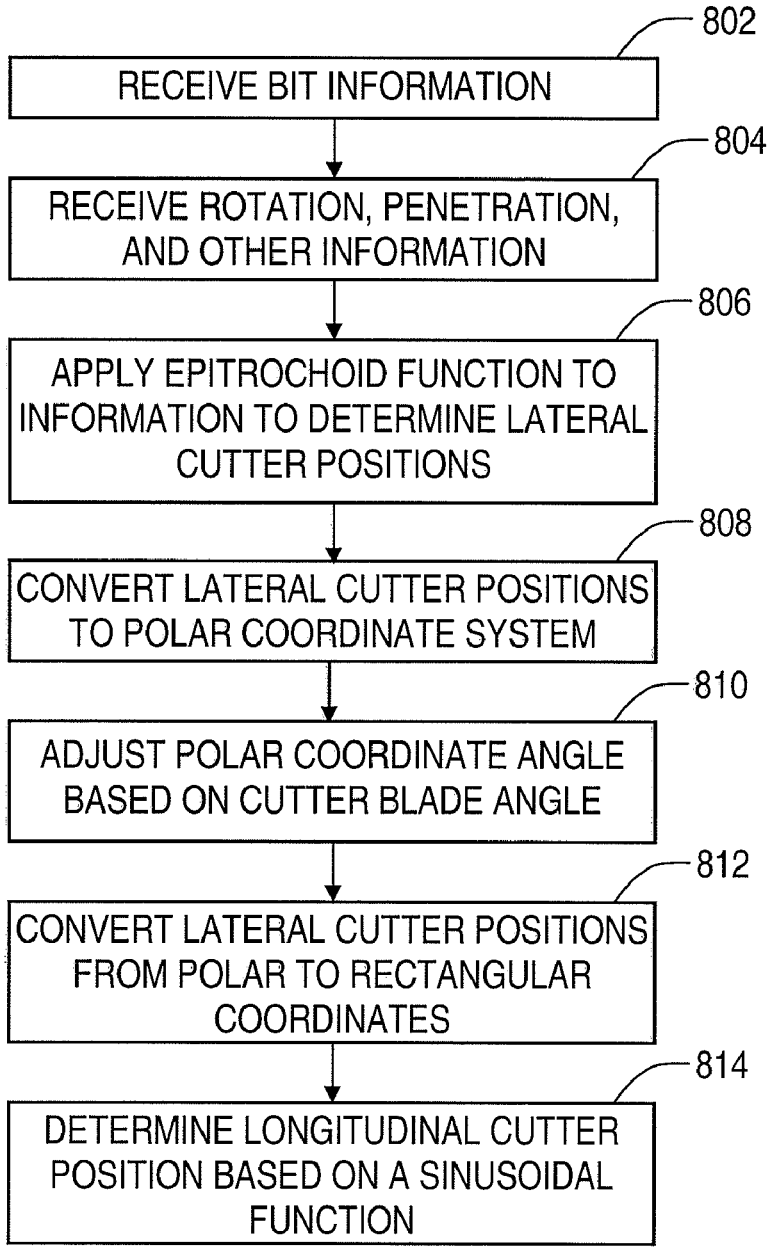
FIG. 8 shows a flow diagram for a method for determining a path traveled by a cutter element of a drill bit in accordance with various embodiments.

FIG. 8 shows a flow diagram for a method for determining a path traveled by a cutter 204 of a drill bit 102 in accordance with various embodiments. Though depicted sequentially as a matter of convenience, at least some of the actions shown can be performed in a different order and/or performed in parallel. Additionally, some embodiments may perform only some of the actions shown. In some embodiments, the operations of FIG. 8, as well as other operations described herein, can be implemented as instructions stored in a computer readable storage medium (e.g., storage 704) and executed by one or more processors (e.g., processor 702).

In block 802, information related to the drill bit 102 is received by the processor 702. The information may be received, for example, from a file stored in the storage 704. The file may contain information defining the location and dimensions of each cutter 204 of the drill bit 102, blade angle, and other parameters of the drill bit 102 and cutters 204. Alternatively, the information may be provided to the processor 102 via a user I/O device 726, such as a keyboard.

In block 804, the other information required to simulate the path of each cutter 204 is received by the processor 702. The information may include, for example, rotational speed of the bent housing 104, rotational speed of the drill bit 102 independent of the rotation of the bent housing 104, dimensions of the bent housing 104, dimensions of the borehole 106, dimensions and location of stabilizers 108, rate of penetration, etc. The information may be read from storage (e.g., storage 704) or provided via a user I/O device 726, such as a keyboard.

In block 806, the received information is processed using an epitrochoidal function (e.g., equations (1)-(2)) to determine the lateral cutter positions (i.e. X and Y cutter coordinates) as the bent housing 104 rotates and the drill bit 102 is driven by the mud motor. The processor 702 may apply the epitrochoidal function to each cutter 204 of the drill bit 102 to generate a unique path for each cutter 204.

In block 808, the processor 702 converts the rectangular coordinate information (derived from the epitrochoidal function) defining the lateral path of the cutter 204 to polar form. The angle associated with each polar coordinate is adjusted, in block 810, based on blade angle to accommodate cutters not beginning the simulation at 0°. The adjusted polar coordinates are returned to rectangular form in block 812.

In block 814, the processor 702, determines the longitudinal positions (i.e., Z cutter coordinates) of the cutter 204 as the as the bent housing 104 rotates and the drill bit 102 is driven by the mud motor. Longitudinal cutter position is based on a sinusoidal function of blade angle and rotation speed combined with rate of penetration as depicted in equation (3).

Figure 9:
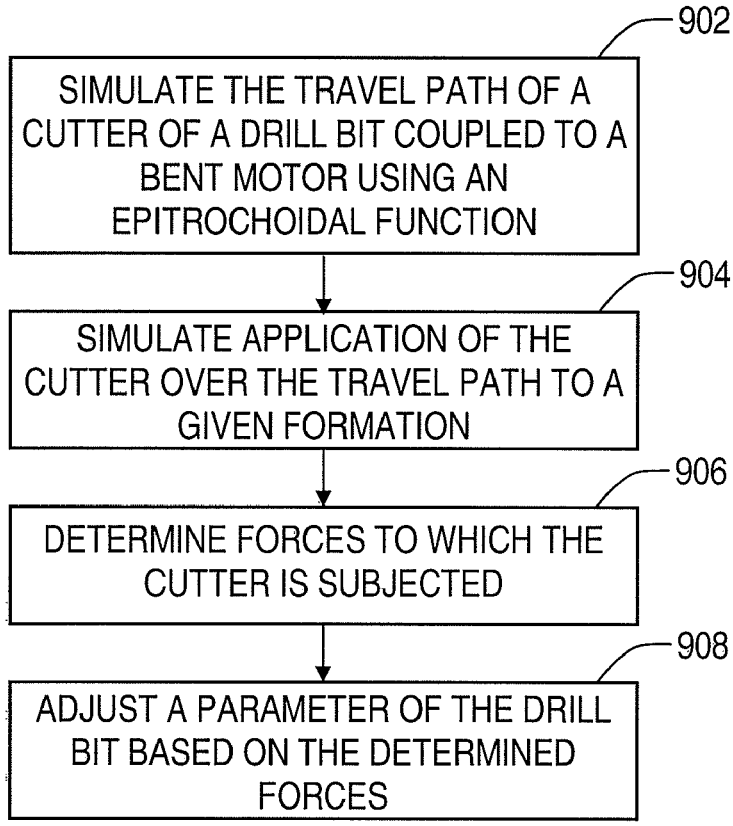
FIG. 9 shows a flow diagram for a method for designing a drill bit based on a drill bit cutter travel path simulated in accordance with various embodiments.

FIG. 9 shows a flow diagram for a method for designing a drill bit 102 based on travel paths of the drill bit cutters 204 simulated in accordance with various embodiments. Though depicted sequentially as a matter of convenience, at least some of the actions shown can be performed in a different order and/or performed in parallel. Additionally, some embodiments may perform only some of the actions shown. In some embodiments, the operations of FIG. 9, as well as other operations described herein, can be implemented as instructions stored in a computer readable storage medium (e.g., storage 704) and executed by one or more processors (e.g., processor 702).

In block 902, the processor 702 executes the cutter path simulation module 708 to simulate the travel path of a cutter 204 of the drill bit 102. The cutter path simulation module 708 determines the complex lateral motion of a cutter 204 as the bent housing 104 rotates and the drill bit 102 rotates independently of the bent housing 104 (e.g., the drill bit is driven by a mud motor) using an epitrochoidal function. The cutter path simulation module 708 determines longitudinal motion of the cutter 204 based on a sinusoidal function. A simulation may be performed to determine the travel path of each cutter 204.

In block 904, the processor 702 executes the force analysis module 714 to simulate application of each cutter 204 to a given formation over the determined travel path of the cutter 204. Embodiments of the force analysis module 714 may apply finite element analysis, or predetermined empirical data related to similar formations and cutters to the determined the forces applied to each cutter 204 in block 906.

In block 908, one or more parameters of the drill bit 102 are adjusted based on the cutter forces identified in the simulation. The adjusted parameters may be entered into the system 700 and the simulation/adjustment cycle repeated to optimize the performance of the drill bit 102.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A method for analyzing operation of a borehole drill bit, comprising:

providing, to one or more processors, information describing the drill bit and a bent housing coupled to the drill bit;

determining, by the one or more processors, a path of a cutter of the drill bit based on a ratio of a rotational speed of the bent housing to a combined rotational speed of the drill bit and the bent housing; and determining a longitudinal position of the cutter based on a sinusoidal function of a blade angle of the drill bit and a ratio of bent housing rotational speed to drill bit rotational speed;

wherein the combined rotational speed is different from the rotational speed of the bent housing.

2. The method of claim 1, wherein the determining comprises applying a lateral force to the drill bit based on an angle of the bent housing.

3. The method of claim 2, wherein the lateral force is based on a diameter of a borehole created by the drill bit.

4. The method of claim 1, further comprising determining forces to which the cutter is subject based on the path and a predetermined formation to which the cutter is applied.

5. The method of claim 4, further comprising changing the information based on the determined forces.

6. The method of claim 1, wherein the determining comprises application of an epitrochoidal function to the information describing the drill bit and the bent housing.

7. The method of claim 1, wherein the information includes at least one parameter selected from a group consisting of radial position of the cutter, blade angle of the cutter, bent housing rotational speed, drill bit rotational speed, rate of penetration, and distance from center of hole to center of bit.

8. The method of claim 1, further comprising applying an angular offset to adjust the path based on a blade angle of the drill bit.

9. A system for analyzing operation of a drill bit in a borehole, comprising:

one or more processors; and cutter path logic that causes the one or more processors to:

determine a path traveled by a cutter of the drill bit based on a ratio of a rotational speed of a bent housing that is coupled to the drill bit to a combined rotational speed of the drill bit and the bent housing; and determine a longitudinal component of the path based on a sinusoidal function of a blade angle of the drill bit and a ratio of bent housing rotational speed to drill bit rotational speed;

wherein the combined rotational speed of the drill bit is different from the rotational speed of the bent housing.

10. The system of claim 9, wherein the cutter path logic determines the path based on an epitrochoidal function.

11. The system of claim 9, wherein the combined rotational speed is a sum of rotational speed of the bent housing and rotational speed imparted to the drill bit by a mud motor.

12. The system of claim 9, wherein the cutter path logic determines the path based on a function of distance from a center of the drill bit to a center of a wellbore, a rotation angle of the bent housing, and distance of the cutter to a centerline of the drill bit.

13. The system of claim 9, wherein the cutter path logic applies a lateral force to the drill bit based on an angle of the bent housing.

14. The system of claim 9, further comprising force determination logic that causes the one or more processors to determine forces to which the cutter is subject based on the path and a predetermined formation being drilled.

15. A method for determining a drill bit parameter of a drill bit design, comprising:

simulating, by a computer, using an epitrochoidal function, a path traveled by a cutter of a simulated drill bit coupled to a bent housing; and changing a parameter of the simulated drill bit based on a result of the simulation;

wherein the simulating determines a longitudinal component of the path based on a sinusoidal function of a blade angle of the cutter and a ratio of bent housing rotational speed to drill bit rotational speed.

16. The method of claim 15, wherein the simulation includes applying a lateral force to the drill bit based on a diameter of a hole drilled by the drill bit and an angle of the bent housing.

17. The method of claim 16, wherein the force is further based on a diameter and location of a stabilizer disposed in a drill string including the drill bit and bent housing.

18. The method of claim 15, wherein the simulation includes rotating the bent housing at a first rate and rotating the drill bit at a second rate.

19. The method of claim 15, further comprising determining forces to which the cutter is subject based on the path and a predetermined formation to which the cutter is applied.

* * * * *